US005484101A

United States Patent [19]

Hedberg

[11] Patent Number: 5,484,101

[45] Date of Patent: Jan. 16, 1996

[54] OPENING ARRANGEMENT

[75] Inventor: Peter Hedberg, Modena, Italy

[73] Assignee: Tetra Laval Holdings & Finance S.A., Pully, Switzerland

[21] Appl. No.: 357,337

[22] Filed: Dec. 15, 1994

[30] Foreign Application Priority Data

Dec. 17, 1993 [SE] Sweden ..... 9304200

[51] Int. Cl.[6] ..... B65Q 5/74; B65D 41/62

[52] U.S. Cl. ..... 229/125.04; 220/254; 220/255; 220/258; 229/125.14

[58] Field of Search ..... 229/125.04, 125.05, 229/125.14, 125.15; 220/254, 258, 255

[56] References Cited

U.S. PATENT DOCUMENTS

| | | | |
|---|---|---|---|
| 2,299,503 | 10/1942 | Sebell | 220/258 |
| 2,413,923 | 1/1947 | Kackley et al. | 220/255 |
| 2,533,305 | 12/1950 | Wells . | |
| 3,282,477 | 11/1966 | Henchert | 220/258 |
| 3,977,591 | 8/1976 | Martensson et al. . | |
| 4,185,754 | 1/1980 | Julius . | |
| 4,359,169 | 11/1982 | Helms et al. | 220/258 |
| 4,464,154 | 8/1984 | Ljungcrantz . | |
| 4,585,498 | 4/1986 | Lagerstedt et al. . | |
| 4,699,290 | 10/1987 | Adams | 220/258 |
| 4,724,979 | 2/1988 | Cleevely et al. | 220/258 |
| 4,770,325 | 9/1988 | Gordon et al. . | |
| 4,813,578 | 3/1989 | Gordon et al. | 229/125.14 |
| 4,815,655 | 3/1989 | Jacobsson et al. . | |
| 4,819,839 | 4/1989 | Carlsson et al. . | |
| 4,838,428 | 6/1989 | Rausing . | |
| 4,913,294 | 4/1990 | Giacomelli . | |
| 4,919,313 | 4/1990 | O'Brien . | |
| 4,930,683 | 6/1990 | Farber . | |
| 4,934,590 | 6/1990 | Robichaud et al. | 229/125.09 |
| 4,986,465 | 1/1991 | Jacobsson et al. . | |
| 5,065,938 | 11/1991 | Anderson . | |
| 5,067,614 | 11/1991 | Jonsson . | |
| 5,101,999 | 4/1992 | Robichard et al. . | |
| 5,110,041 | 5/1992 | Keeler . | |
| 5,142,843 | 9/1992 | Reil et al. . | |
| 5,199,618 | 4/1993 | Reil et al. | 220/258 |
| 5,364,019 | 11/1994 | Bjorck et al. | 229/125.09 |

FOREIGN PATENT DOCUMENTS

| | | |
|---|---|---|
| 0165639 | 12/1985 | European Pat. Off. . |
| 0310180 | 4/1989 | European Pat. Off. . |
| 0340339 | 11/1989 | European Pat. Off. . |
| 0444862 | 9/1991 | European Pat. Off. . |
| 0558946 | 9/1993 | European Pat. Off. . |
| 363931 | 9/1962 | Switzerland . |
| 90/14280 | 11/1990 | WIPO . |
| 92/00884 | 1/1992 | WIPO . |

*Primary Examiner*—Gary E. Elkins
*Attorney, Agent, or Firm*—Burns, Doane, Swecker & Mathis

[57] ABSTRACT

In an opening arrangement for a package, the package being manufactured from a packaging material, the opening arrangement includes a hole punched in the material. The opening arrangement further includes a strip having a first portion which, prior to filling and forming of the package, is sealed to the material over the hole. The strip has a second portion folded over the first portion of the strip. The opening arrangement further includes a thermoplastic structure surrounding the strip including a pouring element and a closure element, the thermoplastic structure being secured to the package. A portion of the second portion of the strip is fixedly sealed against the closure element of the thermoplastic structure.

10 Claims, 5 Drawing Sheets

OPENING ARRANGEMENT

TECHNICAL FIELD

The present invention relates to an opening arrangement for liquid packages manufactured from a material web or a material sheet, and comprising a hole or hole indication which is punched in the material and which, prior to filling and forming of the package, is closed by means of a strip which has an unsealed portion folded over the sealed portion of the strip, and a thermoplastic structure surrounding the strip and consisting of a pouring element and a closure element, and being secured to the finally formed package.

BACKGROUND ART

The type of package which is manufactured from a laminate consisting of a paperboard or paper core with thermoplastic and aluminium foil can be manufactured from a continuous material web or from individual blanks. This type of package is often provided with an opening arrangement consisting of a so-called pull-tab which is torn off when the package is opened. It is also known in the patent literature, for example from Swedish Patent Application SE-9200391-2, to provide this type of package with an outer thermoplastic structure which surrounds and partly covers the strip. This thermoplastic structure may be designed with a pouring element and a closure element and, by means of a hinge function, the two elements can be folded over one another and configurationally rigidly engage in one another. The strip lying beneath this thermoplastic structure often has a part which is unsealed and is folded over the sealed portion of the strip. This provision is to make possible, in a simple manner, the grasping of the strip and its tearing off when the package is opened.

However, difficulties may be experienced in simply grasping the unsealed portion of the strip when the unsealed folded-over portion is pressed against the sealed portion as a result of the manufacturing process and treatment in the filling machine, so that the unsealed portion lies tightly pressed against the sealed portion.

OBJECTS OF THE INVENTION

One object of the present invention is to realise an opening arrangement which possesses the properties of the above-disclosed prior art opening arrangements, but which obviates the problems inherent in lifting the unsealed, free end of the strip, so that it is easy to grasp the free end of the strip and manually tear it off or that the strip is teared off in the same opening procedure.

SOLUTION

This and other objects have been attained according to the present invention in that the opening arrangement of the type described by way of introduction has been given the characterizing feature that the unsealed portion of the strip is, at a part area, fixedly sealed to the closure element of the thermoplastic structure.

Preferred embodiments of the present invention have further been given the characterizing features as set forth in the appended subclaims.

BRIEF DESCRIPTION OF THE ACCOMPANYING DRAWINGS

One preferred embodiment of the present invention will now be described in greater detail hereinbelow, with particular reference to the accompanying Drawings, in which.

The Drawings show only those details essential to an understanding of the present invention.

DESCRIPTION OF PREFERRED EMBODIMENT

Figure 8:
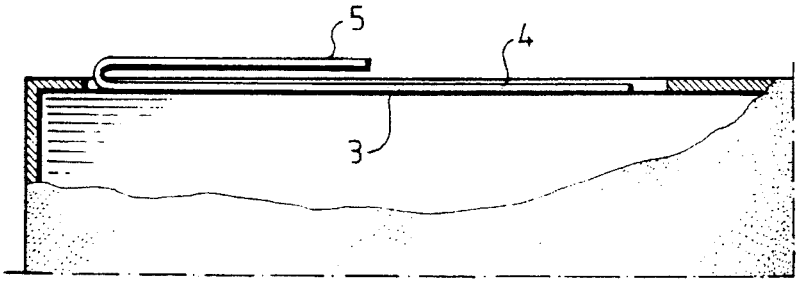
FIG. 8 shows a second embodiment of the pull-tab strip, partly in section.

All figures, except FIG. 8 show the opening arrangement 1 in different stages of opening. They also show the opening arrangement 1 applied on a package 2 of the type which is manufactured from a laminate, with a core of paper or paperboard to which thermoplastic layers and possibly aluminium are laminated. This package 2 may be manufactured from a continuous material web, but may also be made from individual material sheets. The Drawings show a liquid package 2 designed with parallelepipedic configuration but the package may also consist, for example, of a conventional so-called gable-top package. The present invention may also be applied on packages manufactured from other types of packaging materials, such as pure plastic materials.

On the upper side of the packaging container 2, a hole 3 or a hole indication has been made. This hole 3 or hole indication is normally covered from beneath by a thermoplastic strip for purposes of realising a liquid-tight package. At the same time, the outer side of the package is provided with a corresponding outer strip 4. Normally, these work stages are already carried out on production of the packaging material and the packaging material is delivered ready to the filling machines, provided with the above described hole 3 with each respective covering strip.

Figure 2:
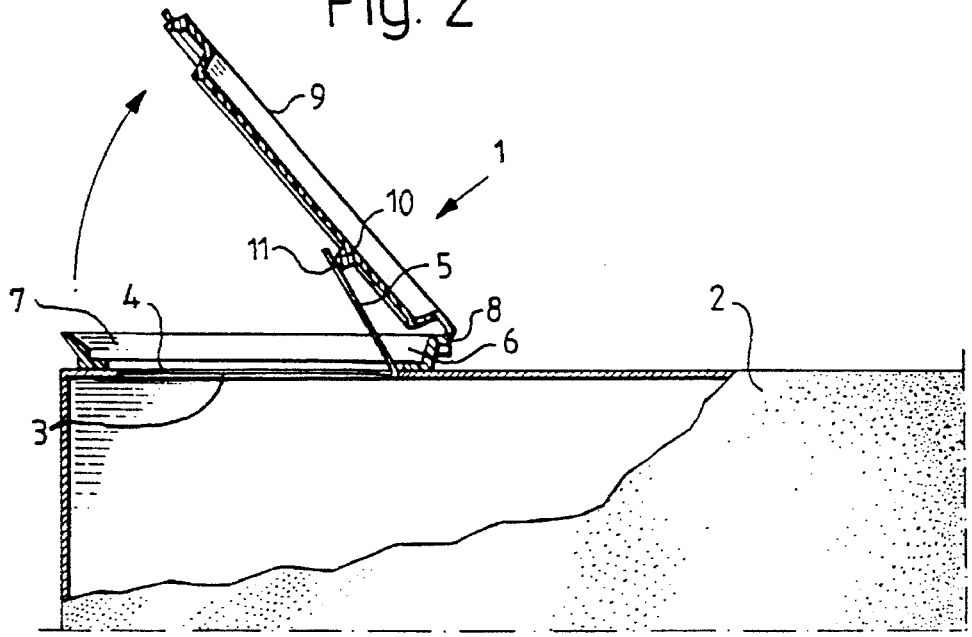
Figure 3:
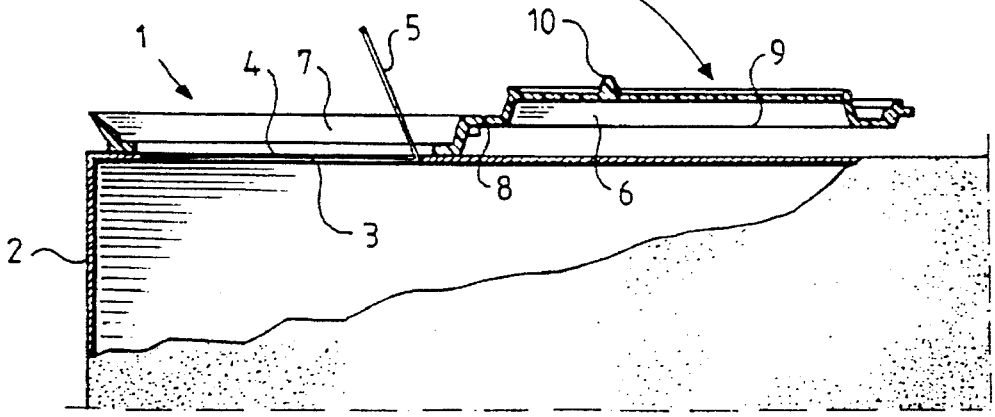

The outer strip 4 normally has a free, unsealed portion 5 which, in the same manufacturing process, is folded over and back towards the sealed portion of the strip 4. As this is carried out in a process preceding the actual handling of the packaging material by the filling machine and before the finished package 2 is filled and finally formed, the free, unsealed portion 5 of the strip 4 will be pressed very hard against the sealed portion of the strip 4. FIGS. 2 and 3 show one method of folding the strip 4, where the free unsealed portion 5 is relatively short compared to the sealed portion 4. In FIG. 8 the pull-tab strip 4 is shown folded in an alternative way and where the free unsealed portion 5 is longer compared to the sealed portion 4 of the strip.

The thus finished packaging material is formed in the filling machine, filled with the intended contents and finally formed into a finished packaging container 2 which may have (as shown in FIG. 1–12) parallelepipedic appearance. An outer thermoplastic structure 6 is then applied onto this ready-filled and finally formed package 2. This thermoplastic structure 6 may, as shown in FIGS. 1–7 and 9–12, consist of two part elements—a pouring element 7 which includes a hole corresponding to or larger than the strip 4 which is applied on the outside of the packaging container 2. A closure element 9 is provided either separately or with a hinge-like portion 8 of thermoplastic. This closure element 9 is folded over the pouring element 7 so as to engage therein in a configurationally stable manner. When the outer thermoplastic structure 6 is to be applied onto the finished packaging container 2, the closure element 9 is folded over the pouring element 7. A sealing substance such as hot melt adhesive is applied on the underside of the pouring element 7, whereupon the outer thermoplastic structure 6 is applied on the packaging container 2. Alternatively, the outer side of the packaging container 2 or the underside of the pouring element 7 can be heated and application of the thermoplastic structure 6 may then take place. The thermoplastic structure 6 is applied on the outer side of the packaging container 2 in such a manner as to surround the strip 4 previously secured to the material, but is wholly discrete from this strip. The thermoplastic structure 6 must be applied in such a manner that the strip 4 is wholly free, this being to ensure that the strip 4 will be accessible on opening of the packaging container 2 and to ensure that the strip will be capable of being pulled off in its entirety.

Figure 1:
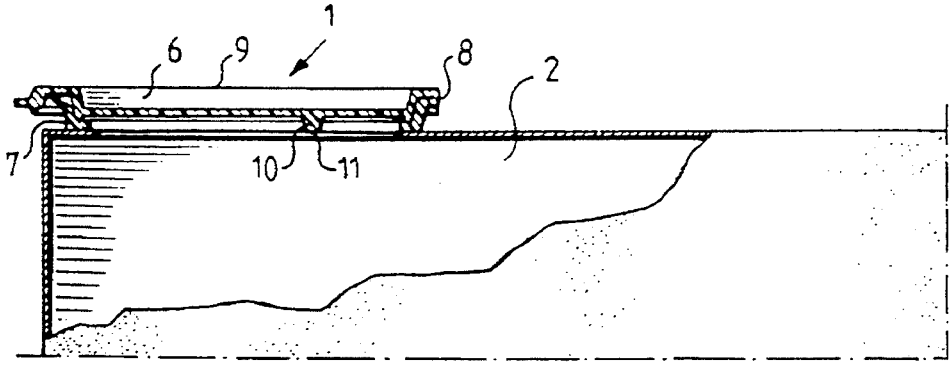
FIGS. 1–3 show a first embodiment of the opening arrangement in different stages of opening, partly in section.
Figure 9:
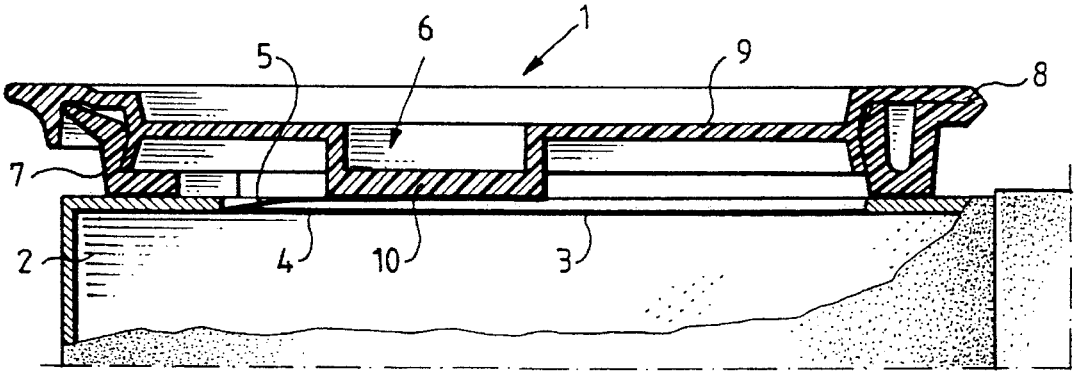
FIG. 9 shows a second embodiment of the opening arrangement.

As shown in FIG. 1 and 9, the closure element 9 or the outer thermoplastic structure 6 is provided with a heel 10 which, when the closure element 9 is folded over the pouring element 7, is located entirely flush with the lower edge of the pouring element 7. The heel 10 may be of varying appearance—it may be rectangular, square or round, but should have a surface area 11 exceeding 1 $mm^2$ in the first embodiment of the invention. In the second embodiment the surface area 11 has to be larger since the heel 10 is to be able to hold tight to the strip 4 and even open the strip 4, when the closure element 7 is opened. In FIGS. 4–7 and 9–12, the heel 10 is shown as a rectangular portion constituting a part of the closure element 9 of the thermoplastic structure 6. When the underside of the outer thermoplastic structure 6 is provided with a sealing substance such as a hot melt adhesive the surface area 11 of the heel 10 lying flush with the lower edge of the pouring element 7 will simultaneously be provided with this hot melt adhesive. When the outer thermoplastic structure 6 is subsequently applied on the outer side of the packaging container 2 surrounding the pull-tab strip 4, the surface area 11 of the heel 10 will be sealed against the pull-tab strip 4. In such instance, the heel 10 must be placed so that this part area 11 adhesion takes place against the folded-over free portion 5 of the strip 4.

Figure 4:
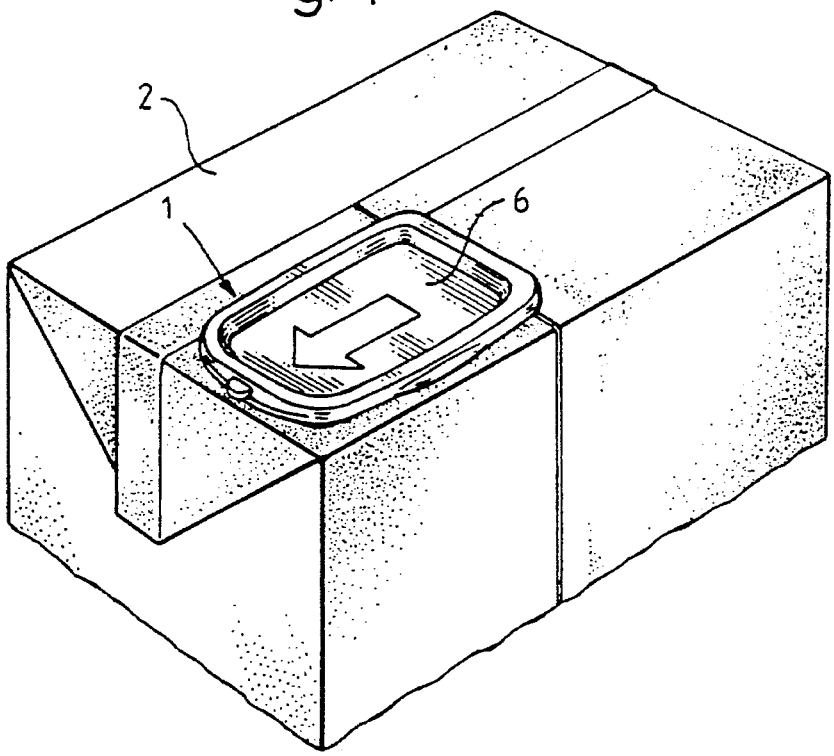
FIGS. 4–7 show a first embodiment of the opening arrangement in different stages of opening.

FIGS. 1 and 4 show the upper side of a packaging container 2 of parallelepipedic configuration provided with an opening arrangement 1 according to the present invention which is disposed in the unopened state. FIG. 1 shows the heel 10 which projects downwards from the closure element 9 and is at a part area 11 sealed against the unsealed, folded-over portion 5 of the strip 4.

FIG. 2 shows how the packaging container 2 is opened by the consumer. When the closure element 9 is in the partly raised position, the heel 10 (which is sealed against the folded-over, unsealed portion 5 of the strip 4) has a hold on the strip, with the result that this portion 5 of the strip 4 accompanies the closure element 9 when this is raised.

Figure 5:
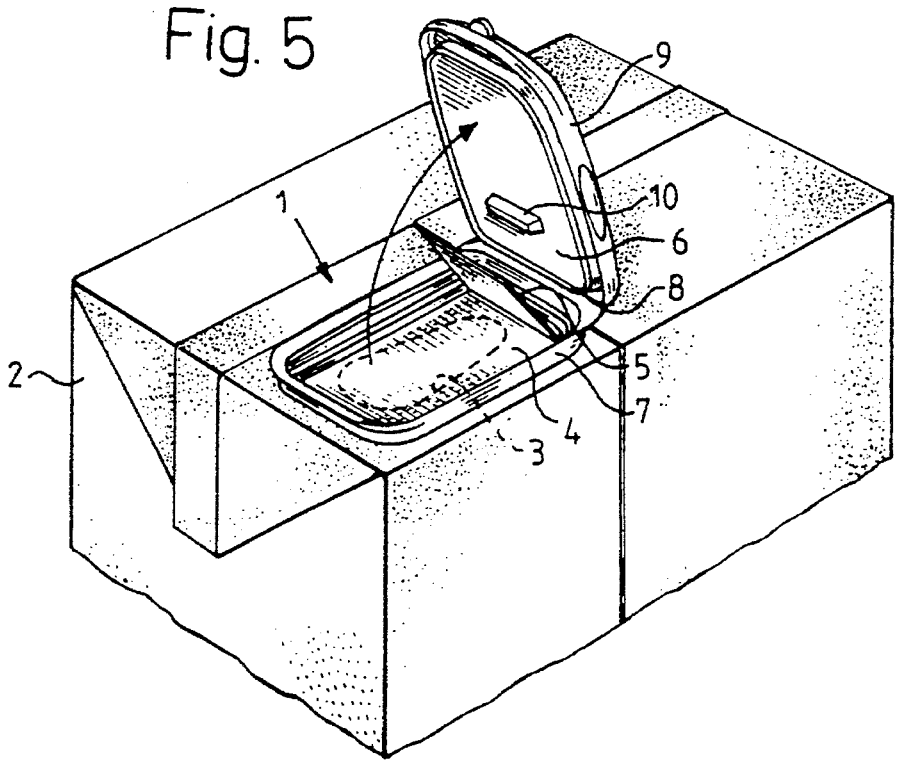

FIG. 5 shows the closure element 9 when it is moved a further distance backwards and, at this point, the seal against the unsealed, folded-over portion 5 of the strip 4 breaks. It is therefore essential that the surface area 11 of the heel 10 downwardly projecting from the closure element 9 in this embodiment is not excessively large, since, in this position, the seal of the heel 10 is to rupture and the unsealed portion 5 of the strip 4 is to remain in the raised position.

In this first embodiment of the invention you automatically get the advantage that the consumer can ascertain that the package 2 has not been tampered with or improperly opened.

Figure 6:
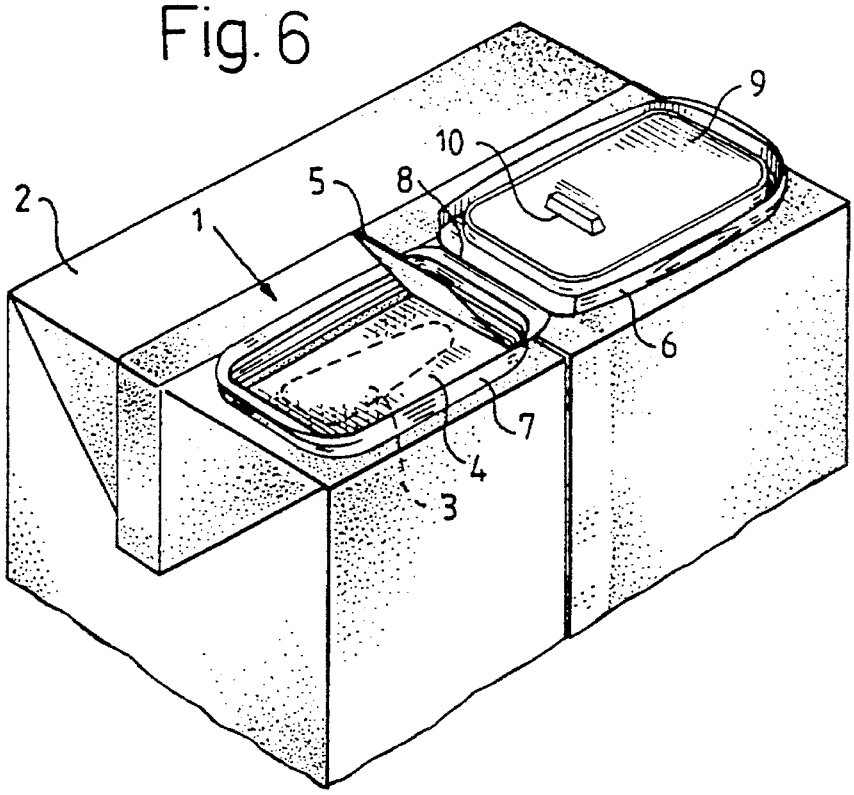
Figure 7:
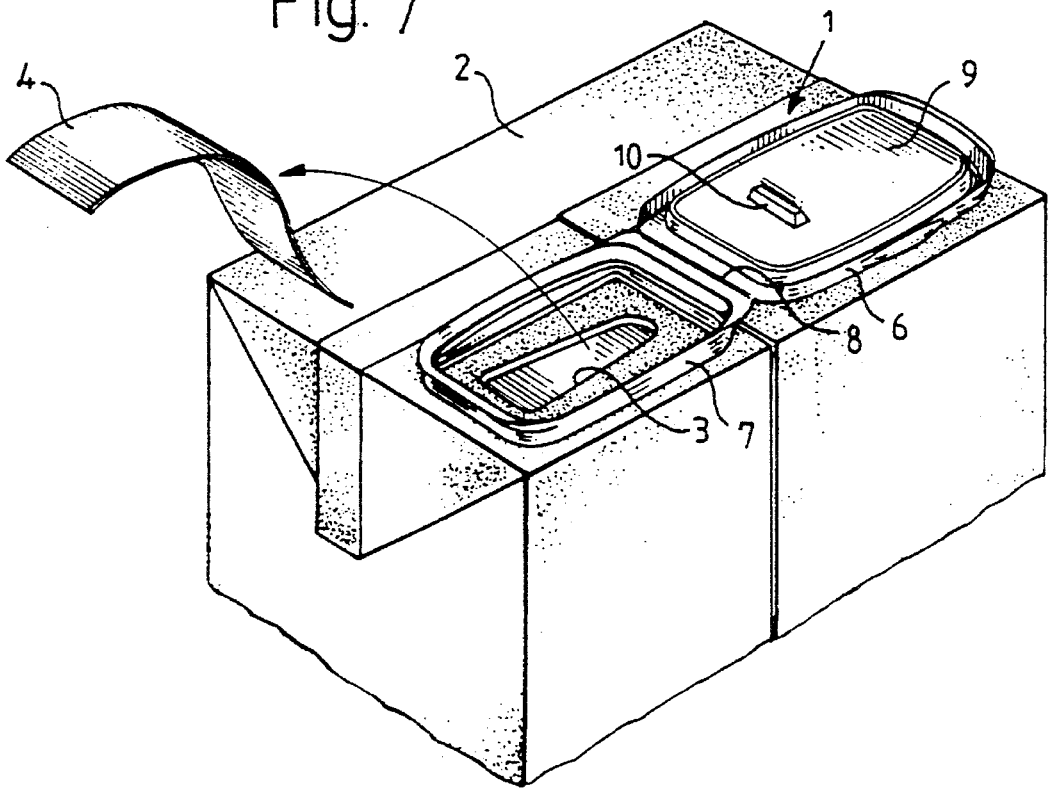

FIGS. 3 and 6 show the opening arrangement with a closure element 9 which has been completely opened. In such instance, it can be seen that the strip 4 is still sealed against that hole 3 or hole indication with which the packaging material is provided. As a result, the consumer will have an indication that the package has not been tampered with or improperly opened and that the contents cannot have been manipulated. The Drawing figures as also show the unsealed, folded-over portion 5 of the strip 4 which is now located in the semi-raised state and is thereby easy to grasp and pull so that the packaging container 2 may finally be opened, as shown in FIG. 7. The thus opened packaging container may be reclosed by moving the closure element 9 back over the pouring element 7 and thereby protect that portion of the contents which has not been immediately consumed.

The second embodiment of the invention is shown in FIGS. 8–12. The pull-tab strip 4 has to be folded over as illustrated in FIG. 8, so that the fold of the strip 4 is orientated towards the opening side of the thermoplastic structure 6. In this embodiment the pull-tab 4 is to be teared off in the same opening procedure as the opening of the thermoplastic structure 6.

FIG. 9 shows a closed opening arrangement where the surface area 11 of the heel 10 is fixedly sealed to the free unsealed portion 5 of the pull-tab strip 4. The surface area 11 of the heel 10 has to be large enough to hold the free portion 5 of the strip 4 during the hole opening procedure.

Figure 10:
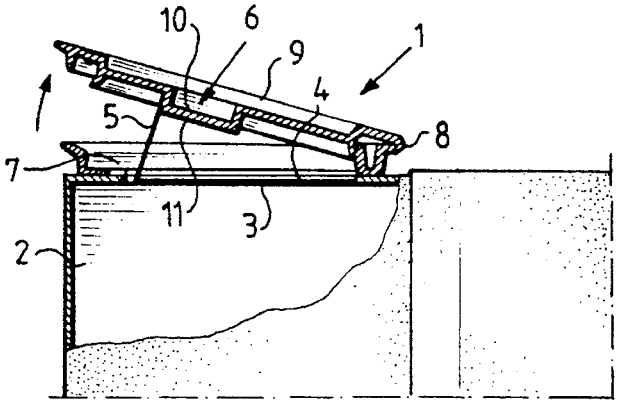
FIG. 10–12 show a second embodiment of the opening arrangement in different stages of opening.

In FIG. 10 the closure element 9 of the thermoplastic structure 6 is just barely opened and the pull-tab strip 4 is still sealed to the package 2.

Figure 11:
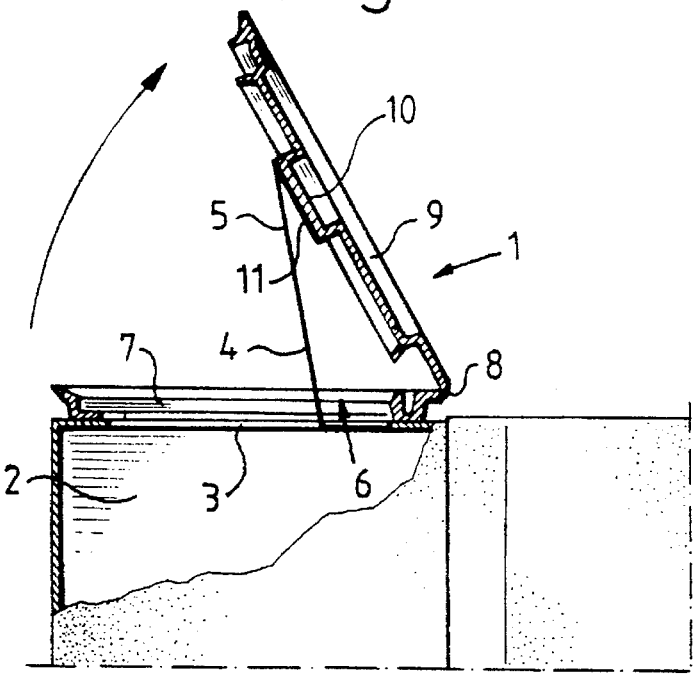
Figure 12:
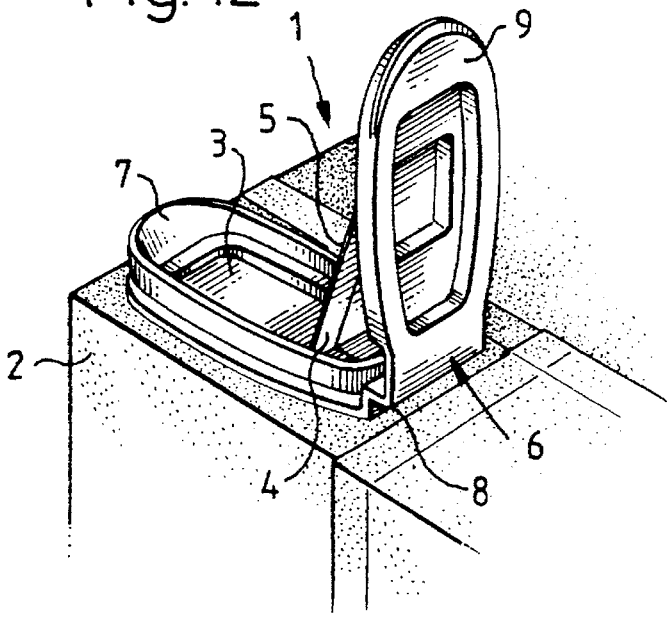

In FIGS. 11–12 the opening procedure is nearly completed and the closure element 6 as well as the strip 4 is opened.

In order to obtain a tamper proof opening arrangement 1, with this second embodiment the thermoplastic structure 6, i.e. can be supplied with small protruding wings (not shown) that will be sealed to the package 2 surface with the thermoplastic structure 6 and which will be broken when the closure element 6 is lifted to be open.

As will have been apparent from the foregoing description, the present invention realises an opening arrangement possessing the favourable properties of prior art opening arrangements but which further improves and simplifies use by the consumer, in that the unsealed, folded-over portion of the strip is readily made available to either be easy to grasp and tear or that the strip is teared off in one opening procedure.

The present invention should not be considered as restricted to that described above and shown on the Drawings, many modifications being conceivable without departing from the spirit and scope of the appended Claims.

What is claimed is:

1. An opening arrangement for a package the package being manufactured from a packaging material, the opening arrangement comprising:

a hole punched in the material;

a strip having a first portion which, prior to filling and forming of the package is sealed to the material over the hole, the strip having a second portion folded over the first portion of the strip; and a thermoplastic structure surrounding the strip including a pouring element and a closure element, the thermoplastic structure being secured to the package, wherein a portion of the second portion of the strip is fixedly sealed against the closure element of the thermoplastic structure.

2. The opening arrangement as claimed in claim 1, wherein the closure element is provided with a heel that is located flush with a lower surface of the pouring element when the closure element is folded over the pouring element.

3. The opening arrangement as claimed in claim 2, wherein the heel has a surface area of at least 1 $mm^2$.

4. The opening arrangement as claimed in claim 1, wherein the thermoplastic structure is secured to the package by a sealing substance.

5. The opening arrangement as claimed in claim 4, wherein the sealing substance includes hot melt adhesive.

6. An opening arrangement for a package, the package being manufactured from a packaging material, the opening arrangement comprising:

a hole indication punched in the material;

a strip having a first portion which, prior to filling and forming of the package, is sealed to the material over the hole indication, the strip having a second portion folded over the first portion of the strip; and a thermoplastic structure surrounding the strip including a pouring element and a closure element, the thermoplastic structure being secured to the package, wherein a portion of the second portion of the strip is fixedly sealed against the closure element of the thermoplastic structure.

7. The opening arrangement as claimed in claim 6, wherein the closure element is provided with a heel that is located flush with a lower surface of the pouring element when the closure element is folded over the pouring element.

8. The opening arrangement as claimed in claim 7, wherein the heel has a surface area of at least 1 $mm^2$.

9. The opening arrangement as claimed in claim 6, wherein the thermoplastic structure is secured to the package by a sealing substance.

10. The opening arrangement as claimed in claim 9, wherein the sealing substance includes hot melt adhesive.

* * * * *